US005474870A

United States Patent [19]

Yamazaki et al.

[11] Patent Number: 5,474,870

[45] Date of Patent: Dec. 12, 1995

[54] TONER FOR DEVELOPING ELECTROSTATIC IMAGE AND PROCESS FOR THE PREPARATION THEREOF

[75] Inventors: Hajime Yamazaki; Hiroshi Hamada; Hiroaki Kataoka; Shinji Otani, all of Tokyo, Japan

[73] Assignee: Hodogaya Chemical Co., Ltd., Tokyo, Japan

[21] Appl. No.: 248,155

[22] Filed: May 24, 1994

[30] Foreign Application Priority Data

May 24, 1993 [JP] Japan ..... 5-142552

[51] Int. Cl.[6] ..... G03G 9/08

[52] U.S. Cl. ..... 430/111; 430/137

[58] Field of Search ..... 430/137, 106, 430/109, 111

[56] References Cited

U.S. PATENT DOCUMENTS

| | | | |
|---|---|---|---|
| 4,533,254 | 8/1985 | Cook et al. | 366/176 |
| 4,702,988 | 10/1987 | Fukumoto et al. | 430/137 |
| 5,102,763 | 4/1992 | Winnik et al. | 430/106 |

FOREIGN PATENT DOCUMENTS

| | | |
|---|---|---|
| 0435691 | 7/1991 | European Pat. Off. . |
| 0443609 | 8/1991 | European Pat. Off. . |
| 2595097 | 9/1987 | France . |

OTHER PUBLICATIONS

Patent Abstracts of Japan, JP 63–113561, May 18, 1988.

*Primary Examiner*—John Goodrow

*Attorney, Agent, or Firm*—Oblon, Spivak, McClelland, Maier & Neustadt

[57] ABSTRACT

A process for producing a toner for developing electrostatic image is disclosed which comprises preparing a suspension of a mixed solution of a polymerizable monomer system containing at least a coloring agent and a release agent and an aqueous medium system and polymerizing the suspension, wherein the suspension is prepared by jetting the mixed solution through a nozzle under elevated pressure in a flowing direction which is forced to vary so that the mixed solution collides with each other or with a predetermined plane to prepare suspended grains, and immediately passing the mixed solution through an apparatus for throttling the path so that back pressure and shearing stress produced by the throttling apparatus are used to adjust the grain diameter and grain size distribution of the suspended grains. The process provides a toner having a small grain diameter and a narrow grain size distribution and comprising additives homogeneously dispersed therein.

6 Claims, No Drawings

TONER FOR DEVELOPING ELECTROSTATIC IMAGE AND PROCESS FOR THE PREPARATION THEREOF

FIELD OF THE INVENTION

The present invention relates to a toner for developing electrostatic image which exhibits an excellent fluidity, chargeability and definition.

BACKGROUND OF THE INVENTION

A toner for use in the development of electrostatic latent image in electrophotography is prepared by a grinding process which comprises kneading a low melting resin with carbon black, a coloring agent such as dye pigment and a charge controlling agent, and then grinding and classifying the material. The toner prepared by the grinding process normally has an average grain diameter of 8 μm to 12 μm and a grain size distribution of 1 μm to 25 μm. In order to obtain grains having a narrower grain size distribution from this product, an accurate classification process is required. However, this classification process takes much time and gives a reduced yield, drastically raising the manufacturing cost and causing an economic problem. Further, in this kneading and grinding process, it is very difficult to homogeneously disperse additives such as coloring agent and charge controlling agent in the low melting resin. The poor dispersion of additives in individual grains deteriorates the properties of the toner. In particular, this causes uneven chargeability that results in unevenness in image quality or printing properties. Therefore, the relationship of the chargeability of individual grains with image quality, average grain diameter and grain size distribution becomes indefinite. This leads to variation of the properties of the toner from lot to lot, giving a poor reproducibility.

Various approaches have been attempted to eliminate the defects of the grinding process. As the most typical example of such an approach, a polymerization process for the preparation of an electrostatic development toner has been proposed.

An example of the polymerization process for the preparation of a dry toner is an emulsion polymerization process in an organic solvent as disclosed in JP-A-61-273552 and JP-A-61-273553 (The term "JP-A" as used herein means an "unexamined published Japanese patent application"). Both of the two proposals are disadvantageous in that the reaction requires the use of an organic solvent, the grain growth takes much time and the resulting grains have a broad grain size distribution.

An example of suspension polymerization process is disclosed in JP-A-61-22354 and JP-A-61-67039. In either process, as a suspension means there is used a homomixer which utilizes a shearing stress produced by a high speed rotary blade during suspension. This method is useful in shearing a polymerizable monomer as a main component but is poor in the production of grains having a narrow grain size distribution. The resulting product has a broad grain size distribution. This method is also disadvantageous in that it is difficult to homogeneously disperse a pigment and other various additives in the polymerizable monomer.

JP-A-63-113561 proposes the production of a dispersion by a high pressure homogenizer adapted to provide grains with a small grain diameter and a narrow grain size distribution and a method which comprises the treatment of a polymerizable monomer in such a dispersion. Referring to the operation mechanism of such a high pressure homogenizer, a pressurized solution to be treated is discharged through a controlled minute gap to a low pressure zone where it is then allowed to collide with an impact member such as impact ring. However, even this method cannot provide a suspension comprising grains having a grain diameter of 5 μm to 16 μm in a proportion of not less than 90%, making it difficult to prepare a product having a narrow grain size distribution with an average grain diameter of 4 μm to 8 μm. Therefore, in order to obtain a product with a small grain diameter and a narrow grain size distribution, a classification process that adds to the manufacturing cost is needed. A known prior art approach for providing a suspension with a smaller grain diameter and a narrower grain size distribution is disclosed in JP-A-5-156555. In this patent, a method is disclosed which comprises the production of a final suspension after pre-suspension. This method can exert an effect of producing a suspension with a smaller grain diameter and a narrower grain size distribution than the prior art suspension process. However, in order to prepare a suspension with a smaller grain diameter and a narrower grain size distribution, this method requires that the number of passes be increased. This causes an extreme increase in the output of finely divided grains. Such a product cannot be practically used as a toner unless these finely divided grains are removed. Thus, this method, too, requires a classification process.

SUMMARY OF THE INVENTION

It is therefore an object of the present invention to provide a suspension polymerization process toner for electrostatic development having an average grain diameter of from 4 μm to 8 μm suitable for high definition and an extremely narrow grain size distribution and comprising additives homogeneously dispersed therein and a process for the preparation thereof.

The foregoing object of the present invention will become more apparent from the following detailed description and examples.

In one aspect of the present invention, a process for producing a toner for developing electrostatic image is provided which comprises preparing a suspension of a mixed solution of a polymerizable monomer system containing at least a coloring agent and a release agent and an aqueous medium system and polymerizing the suspension, wherein the suspension is prepared by jetting the mixed solution through a nozzle under elevated pressure in a flowing direction which is forced to vary so that the mixed solution collides with each other or with a predetermined plane to prepare suspended grains, and immediately passing the mixed solution through an apparatus for throttling the path (e.g., various valves and capillaries) so that back pressure and shearing stress produced by the throttling apparatus are used to adjust the grain diameter and grain size distribution of the suspended grains.

In another aspect of the present invention, a toner is provided for developing electrostatic image prepared by a process which comprises preparing a suspension of a mixed solution of a polymerizable monomer system containing at least a coloring agent and a release agent and an aqueous medium system and polymerizing the suspension, wherein the suspension is prepared by jetting the mixed solution through a nozzle under elevated pressure in a flowing direction which is forced to vary so that the mixed solution collides with each other or with a predetermined plane to prepare suspended grains, and immediately passing the mixed solution through an apparatus for throttling the path so that back pressure and shearing stress produced by the throttling apparatus are used to adjust the grain diameter and grain size distribution of the suspended grains.

The inventors made extensive studies on suspension process in the foregoing suspension polymerization process for the preparation of a toner. As a result, the following advantages have been found. In some detail, when a mixture to be suspended falling within specific conditions of the kind and amount of dispersant in a dispersion and the proportion of water in the dispersion to a polymerizable monomer as a main component is allowed to collide with each other or with a predetermined plane, immediately followed by the passage through an apparatus for throttling the path, the solution to be processed is acted on by some back pressure and shearing stress, enabling the production of grains having an average grain diameter of 4 μm to 8 μm, including those having a grain diameter of 3 μm to 12 μm necessary for dry electrophotographic developing toner in a proportion of 13 to 350% higher than the conventional process, and an extremely narrow distribution of grain size and comprising various additives dispersed therein through less passes than the conventional process. The grains can then be polymerized to prepare a toner for developing electrostatic image that can provide a high definition without any fog and unevenness at a high productivity and a low manufacturing cost.

DETAILED DESCRIPTION OF THE INVENTION

The present invention will be further described hereinafter.

In accordance with the present invention, at least a polymerizable monomer, a coloring agent, a release agent, a charge controlling agent, and slight amounts of other additives are subjected to dispersion with stirring by means of a high speed agitator. The dispersion is then added to a dispersion medium composed of water, a surface active agent and a dispersion stabilizer. The mixture is then subjected to pre-suspension by means of a high speed agitator such as T. K. autohomomixer (available from Tokushu Kika Kogyo K. K.) to form oil drops having an average grain diameter of 30 μm to 40 μm.

The pre-suspended mixture is then processed (i.e., jetted through nozzles) under a processing pressure of generally from 1,000 psi to 18,000 psi, preferably from 1,000 to 10,000, by means of a high pressure collision type emulsifier such as apparatus as disclosed in U.S. Pat. No. 4,533,254 (trade name: Microfluidizer), and immediately acted on (1) by a back pressure of 0.1% to 50% (preferably 0.2% to 20%) of the processing pressure through various valves (such as a needle valve, a ball valve and a gate valve) or (2) by a shearing stress and back pressure produced by adjusting the flow rate to 100 m/min to 2,000 m/min (preferably 200 m/min to 1200 m/min) through a capillary having a length of not less than 0.5 m. This procedure can be effected once or twice to form oil drops having a grain diameter of 4 μm to 8 μm and an extremely narrow grain size distribution and comprising a coloring agent, a release agent, a charge controlling agent, and other additives homogeneously dispersed therein.

A high pressure homogenizer disclosed in JP-A-63-113561, as well as the above-mentioned a high pressure collision type emulsifier, can be exemplified as the apparatus in which suspended grains are prepared by jetting the mixed solution through a nozzle under elevated pressure in a flowing direction which is forced to vary so that the mixed solution collides with each other or with a predetermined plane.

In a preferred embodiment of the suspension composition according to the present invention, water is used in an amount of 2.5 times to 6 times by weight that of the polymerizable monomer, a surface active agent is used in a concentration of 0.4 times to twice c.m.c. thereof, and a dispersion stabilizer is used in an amount of from 2 to 6% by weight based on the amount of the water (i.e., from 2 to 6 parts by weight per 100 parts by weight of the amount of the water). The suspension of the present invention is then allowed to undergo ordinary heat polymerization reaction. During the polymerization reaction, no change occurs in the distribution of grains produced by suspension and the dispersion condition of additives. After the completion of polymerization reaction, the product is subjected to rinsing or the like to remove the surface active agent and dispersion stabilizer therefrom, and then dried to obtain a toner powder.

Preferred examples of radically polymerizable monomers employable in the present invention include styrene monomers such as styrene, o-methylstyrene, m-methylstyrene, p-methylstyrene, α-methylstyrene, p-ethylstyrene, 2,4-dimethylstyrene, p-butylstyrene, p-t-butylstyrene, p-hexylstyrene, p-octylstyrene, p-nonylstyrene, p-decylstyrene, p-dodecylstyrene, p-methoxystyrene, p-phenylstyrene, p-chlorostyrene and 3,4-dichlorostyrene. Other examples of radically polymerizable monomers employable in the present invention include ethylenically unsaturated monoolefins such as ethylene, propylene, butylene and isobutylene, halogenated vinyls such as vinyl chloride, vinylidene chloride, vinyl bromide and vinyl fluoride, vinylesters such as vinyl acetate, vinyl propionate, vinyl benzoate and vinyl butyrate, α-methylene aliphatic monocarboxylic esters such as methyl acrylate, ethyl acrylate, butyl acrylate, propyl acrylate, octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, butyl methacrylate, isobutyl methacrylate, octyl methacrylate, dodecyl methacrylate, lauryl methacrylate, 2-ethylhexyl methacrylate, stearyl methacrylate, phenyl methacrylate, dimethylaminoethyl methacrylate and diethylaminoethyl methacrylate, acrylic acid or methacrylic acid derivatives such as acrylonitrile, methacrylonitrile and acrylamide, vinylethers such as vinyl methyl ether, vinyl ethyl ether and vinyl isobutyl ether, vinyl ketones such as vinyl methyl ketone, vinyl hexyl ketone and methyl isopropenyl ketone, N-vinyl compounds such as N-vinylpyrrole, N-vinylcarbazole, N-vinylindole and N-vinylpyrrolidone, and vinyl naphthalenes. These monomers may be used singly or in combination. These monomers may also be used in such a combination that they are polymerized to give a copolymer. Among these monomers, styrene or styrene derivatives is preferably used singly or in admixture with other monomers as a polymerizable monomer in the light of development properties and durability.

The monomer composition may preferably comprise a low softening compound (release agent) having release characteristics such as wax, e.g., paraffin wax and low molecular polyolefin, e.g., low molecular polyethylene and low molecular polypropylene to improve its fixability and offset resistance in hot press roller fixing. The amount of such a release agent to be added is in the range of 1 to 30 parts by weight per 100 parts by weight of polymerizable monomer.

As the low softening compound to be used as a release agent there may be exemplified paraffin, wax, low molecular polyolefin, modified wax having aromatic group, hydrocarbon compound having an alicyclic group, natural wax, long-chain aliphatic carboxylic acid containing long hydrocarbon chain having 12 or more carbon atoms, or ester thereof. Different low softening compounds may be used in admixture. Specific examples of such a low softening compound include Paraffin Wax (available from Nippon Oil Company, Ltd.), Microwax (available from Nippon Oil Company, Ltd.), Microcrystalline Wax (available from Nippon Seiro Co., Ltd.), hard paraffin wax (available from Nippon Seiro Co., Ltd.), PE-130 (available from Hoechst), Mitsui Hiwax 110P (available from Mitsui Petrochemical Industries, Ltd.), Mitsui Hiwax 220P (available from Mitsui Petrochemical Industries, Ltd.), Mitsui Hiwax 660P (available from Mitsui Petrochemical Industries, Ltd.), Mitsui Hiwax 210P (available from Mitsui petrochemical Industries, Ltd.), Mitsui Hiwax 320P (available from Mitsui petrochemical Industries, Ltd.), Mitsui Hiwax 410P (available from Mitsui Petrochemical Industries, Ltd.), Mitsui Hiwax 420P (available from Mitsui Petrochemical Industries, Ltd.), Hirez T-100X (available from Mitsui Petrochemical Industries, Ltd.), Hirez T-200X (available from Mitsui Petrochemical Industries., Ltd.), Hirez T-300X (available from Mitsui Petrochemical Industries, Ltd.), Petrosin 80 (available from Mitsui Petrochemical Industries, Ltd.), Petrosin 100 (available from Mitsui Petrochemical Industries, Ltd.), Petrosin 120 (available from Mitsui Petrochemical Industries, Ltd.), Tackace A-100 (available from Mitsui Petrochemical Industries, Ltd.), Tackace F-100 (available from Mitsui Petrochemical Industries, Ltd.), Tackace B-60 (available from Mitsui Petrochemical Industries, Ltd.), modified wax JC-1141 (available from Mitsui Petrochemical Industries, Ltd.), modified wax JC-2130 (available from Mitsui Petrochemical Industries, Ltd.), modified wax JC-4020 (available from Mitsui Petrochemical Industries, Ltd.), modified wax JC-1142 (available from Mitsui Petrochemical Industries, Ltd.), modified wax JC-5020 (available from Mitsui Petrochemical Industries, Ltd.), Biscol 550P (available from Sanyo Chemical Industries, Ltd.), Biscol 660P (available from Sanyo Chemical Industries, Ltd.), Biscol TS-200 (available from Sanyo Chemical Industries, Ltd.), Sanwax 151P (available from Sanyo Chemical Industries, Ltd.), beeswax, carnauba wax, montan wax, and candelilla wax.

The polymer according to the present invention may be a crosslinked polymer obtained by the polymerization of monomers in the presence of a crosslinking agent. Such a crosslinking agent is preferably added to the system particularly when the monomer composition comprises no polymer, coplymer or cyclized rubber incorporated therein. A crosslinking agent which can be preferably used in the present invention is a compound mainly having two or more polymerizable double bonds. Examples of such a compound include aromatic divinyl compounds such as divinylbenzene, divinylnaphthalene, and derivatives thereof. Specific examples of these aromatic divinyl compounds include diethylenically carboxylic esters such as ethyleneglycol dimethacrylate, diethyleneglycol methacrylate, triethyleneglycol methacrylate, trimethylol propanetriacrylate, allylmethacrylate, tetraethyleneglycol dimethacrylate and 1,3-butanediol dimethacrylate, various divinyl compounds such as N,N-divinylaniline, divinylether, divinylsulfide and divinylsulfone, and compounds having three or more vinyl groups. These compounds may be used singly or in combination.

The amount of such a crosslinking agent to be incorporated in the monomer is in the range of 0,005% to 20% by weight, preferably 0.1% to 10% by weight. If this amount exceeds the above specified range, it raises the softening point of the toner, deteriorating the heat fixability or hot-press fixability of the toner. On the contrary, if this amount falls below the above specified range, properties necessary for toner such as durability, blocking resistance and abrasion resistance can hardly be imparted to the toner. In particular, it reduces the effect of the expansion of the distribution of molecular weight of the polymer by crosslinking and the effect of inhibiting offset during fixing by the nature of crosslinked polymer toner itself in heat roll fixing process copying machines or the like.

The polymerizable monomer composition according to the present invention comprises a coloring agent incorporated therein. As such a coloring agent there may be preferably used a dye pigment or particulate magnetic substance. As such a dye pigment there can be used a known dye or a known pigment such as carbon black and grafted carbon black obtained by covering the surface of carbon black by a resin. The amount of such a dye pigment to be incorporated is in the range of 0.1% to 20% by weight based on the weight of polymerizable monomer.

On the other hand, as the particulate magnetic substance employable in the present invention there can be used a substance that can be magnetized in a magnetic field. Examples of such a magnetizable substance include ferromagnetic metal such as iron, cobalt and nickel or alloy or compound such as magnetite, hematite and ferrite, in the form of powder. A particulate magnetic substance having a primary grain diameter of 0.05 μm to 5 μm (more preferably 0.1 μm to 1 μm) may be preferably used. The content of the particulate magnetic substance is preferably in the range of 10% to 60% by weight (more preferably 25% to 50% by weight) based on the weight of toner. The particulate magnetic substance may be treated with a known surface modifier or a resin having a proper reactivity.

The toner may comprise a charge controlling agent and a fluidity modifier incorporated therein as necessary. The charge controlling agent and fluidity modifier may be mixed with the toner grains. Examples of such a charge controlling agent include metal complexes of organic compounds containing carboxyl group or nitrogen-containing group, metal-containing dyes, nigrosine, and alkylonium salts. As the fluidity modifier or cleaning aid for the surface of a latent image carrier (photoreceptor) there may be used colloidal silica, aliphatic metal salt or the like. The toner may comprise a filler such as calcium carbonate and finely divided silica grains in an amount of 0.5% to 20% by weight based on the toner for the purpose of filling the toner.

For the monomer polymerization, a radical polymerization initiator is normally used in an amount of 0.1 to 10% by weight based on the weight of radically polymerizable monomer. The proper amount of such a radical polymerization initiator is determined by the final polymerization degree.

Specific examples of such a polymerization initiator include peroxides such as acetylcyclohexylsulfonyl peroxide, isobutyl peroxide, diisopropylperoxy dicarbonate, di-2-ethylhexylperoxy dicarbonate, 2,4-dichlorobenzoyl peroxide, 1-butylperoxy pivalate, 3,5,5-trimethylhexanoyl peroxide, octanoyl peroxide, stearoyl peroxide, propionyl peroxide, succinic acid peroxide, acetyl peroxide, t-butylperoxy-2-ethylhexanoate, benzoyl peroxide, parachlorobenzoyl peroxide, t-butylperoxy isobutyrate, t-butylperoxymaleic acid, t-butylperoxy laurate, cyclohexanone peroxide, t-butylperoxyisopropyl carbonate, 2,5-dimethyl-2,5-dibenzoylperoxyhexane, t-butylperoxyacetate, t-butylperoxybenzoate, diisobutyldiperoxyphalate, methyl ethyl ketone peroxide, dicumyl peroxide, 2,5-dimethyl-2,5-di-t-butylperoxyhexane, t-butylcumyl peroxide, t-butyl hydroperoxide, di-t-butyl peroxide, 2,5-dimethyl-2,5-di-t-butylperoxyhexane, diisopropylbenzene hydroperoxide, paramethane hydroperoxide, pinane hydroperoxide, 2,5-dimethylhexane-2,5-dihydroperoxide and cumen hydroperoxide, and azo compounds such as 2,2'-azobisisobutyronitrile, 1,1'-azobis(cyclohexane-1-carbonitrile), 2,2'-azobis(4-methoxy-2,4dimethylvaleronitrile), 2,2'-azobis(2,4-dimethylvaleronitrile), 2,2'-azobis(2-cyclopropylpropionitrile), 2,2'-azobis(2-methylbutyronirile) and dimethyl-2,2'-azobis(2-methylpropionate).

Further, a polar polymer or an elastomeric polymer may be added to the system during polymerization to improve the physical properties of the polymer toner.

An oil phase mainly composed of the foregoing polymerizable monomer needs to be stably dispersed in water with a desired grain diameter and in a desired grain size distribution. Examples of a dispersion stabilizer for this purpose include polyvinyl alcohol, gelatin, methyl cellulose, methylhydropropyl cellulose, ethyl cellulose, sodium salt of carboxymethyl cellulose, polyacrylic acid, salts thereof, starch, gum alginate, zein, casein, calcium tertiary phosphate, talc, barium sulfate, bentonite, aluminum hydroxide, and ferric hydroxide. Such a dispersion stabilizer is related to the amount of the following surface active agent to be used and the amount of water as the suspension medium in the polymerizable monomer as an oil phase. The amount of such a dispersion stabilizer to be used is preferably in the range of 2% to 6% by weight based on the weight of water.

Examples of surface active agents to be used in combination with the dispersion stabilizer include sodium dodecylbenzenesulfonate, sodium tetradecylsulfate, sodium pentadecylsulfate, sodium octylsulfate, sodium allylalkylpolyethersulfonate, sodium oleate, sodium laurate, sodium caprinate, sodium caprylate, sodium capronate, sodium stearate, sodium oleate, sodium 3,3-disulfonediphenylurea-4,4-diazo-bis-amino-8-naphthol-6-sulfonate, orthocarboxybenzene-azo-dimethylaniline, and sodium 2,2,5,5-tetramethyl-triphenylmethane-4,4-diazo-bis-β-naphthol-disulfonate. The optimum amount of such a surface active agent to be used is in the range of 0.4 times to twice the characteristic c.m.c. (critical micelle concentration) thereof based on the weight of water used.

The amount of water to be used during suspension is preferably in the range of 2.5 times to 6 times the weight of polymerizable monomer as main component. As water to be used, ion-exchanged water less contaminated by salts is desirable.

In the present invention, after the formation of oil drops by suspension, a polymerization reaction is initiated at a temperature of about 60° C. by an ordinary method. Finally, the reaction is completed at a temperature of 90° C. to 100° C. After cooling, the dispersion stabilizer and surface active agent are removed. The material is washed with water, dried at a temperature of 40° C. to 50° C., milled, and then optionally treated with a surface treatment to obtain a toner in a high yield.

If the toner according to the present invention is used as a binary developer (two component development), a carrier commonly used for toner maybe used. In some detail, an iron powder carrier or ferrite carrier may be used. Further, a resin-coated carrier obtained by covering such a material as a core by a polyester resin, fluorinic resin or silicone resin or a so-called resin carrier obtained by kneading iron powder or ferrite with a binder resin to effect granulation may be used.

The polymer toner prepared according to the present invention can be applied to known dry electrostatic development processes. In particular, it is preferably used as a high definition toner which needs to have a sharp grain size distribution and as small an average grain diameter as 4 μm to 8 μm.

The present invention will be further described in the following examples, but the present invention should not be construed as being limited thereto. The term "parts" as used herein indicates "parts by weight".

EXAMPLE 1

To 300 parts of styrene monomer/2-ethylhexyl acrylate/divinylbenzene were added 15 parts of Carbon Black MA-100 (available from Mitsubishi Kasei Corp.), 6 parts of Biscol 660P (Sanyo Chemical Industries, Ltd.), 9 parts of 2,2-azobis(2,4-dimethyl)valeronitrile, 3 parts of azobisisobutyronitrile, and 3 parts of Aizen Spiron Black TRH as a charge controlling agent (available from Hodogaya Chemical Co., Ltd.). The mixture was then subjected to high speed dispersion at 10,000 rpm by means of T. K. autohomomixer (available from Tokushu Kika Kogyo K. K.) for 20 minutes at 3° to 10° C. to prepare an oil phase mainly composed of a polymerizable monomer. On the other hand, a dispersion medium containing 456 parts of a 10% calcium tertiary phosphate solution (available from Taihei Kagaku Sangyo K. K.) and 118 parts of a 0.178% aqueous solution of sodium dodecylbenzenesulfonate in 524 parts of ion-exchanged water was prepared. To the dispersion medium were added 300 parts of the oil phase previously prepared. The mixture was then subjected to pre-suspension at a temperature 3° C. to 10° C. at 3,000 rpm for 15 minutes and then at 4,000 rpm for 20 minutes by means of T. K. autohomomixer. The suspension was effected by passing the pre-suspended mixture twice through Microfluidizer M-110T (available from Microfluindex Corp. of U.S.A.) equipped with a Z-shaped chamber and an emulsifier having a needle valve connected to its product outlet under a processing pressure of 8,000 psi and a back pressure of 25 psi. The resulting suspension comprised oil drops having an average grain diameter of 5.7 μm as determined by SK Laser Micronthizer PRO-7000S (available from Seishin Kigyo K. K.). The percent product of finely divided grains having a grain diameter of not more than 3 μm was 2.0%. The percent product of coarse grains having a grain diameter of not less than 12 μm was 3.0%. The suspension was then allowed to undergo a polymerization reaction at a temperature of 60° C. for 6 hours and then at a temperature of 90° C. for 1 hour in an autoclave equipped with an agitator. After cooling, hydrochloric acid was added to the reaction system so that calcium tertiary phosphate was dissolved therein. The reaction system was filtered off, washed with water, and then dried to obtain a toner having an average grain diameter of 5.7 μm and a narrow grain size distribution such that grains having a grain diameter of more than 3 μm but less than 12 μm account for 95.0% of all the grains and comprising a pigment homogeneously dispersed therein. The toner grains thus obtained were almost spherical and were also free of color unevenness. The toner was measured for triboelectrification distribution with an iron powder carrier DSP-128 (available from Dowa Teppun K. K.) by means of Espert Analyzer EST-1 (available from Hosokawa Micron Corporation). As a result, a very sharp negative elelctrification distribution was shown free of opposite polarity. 100 parts of the foregoing toner were mixed with 1 part of colloidal silica. The toner was then mixed with a ferrite carrier in a concentration of 4% by weight to prepare a developer. A commercially available copying machine was used to evaluate the developer for printing properties. A high definition printed matter with a high sharpness was obtained free of fog and unevenness.

COMPARATIVE EXAMPLE 1

Using the same composition as in Example 1, the same procedure as used in Example 1 was effected until the pre-suspension. The suspension was effected in the same manner as in Example 1 except that Microfluidizer M-110T had nothing connected to its product outlet. The resulting oil drops had an average grain diameter as large as 23.5 μm. In an attempt to bring the average grain diameter of oil drops close to the result of Example 1, the foregoing procedure was further repeated twice. The resulting suspension comprised oil drops having an average grain diameter of 8.4 μm.

The percent production of finely divided grains having an average grain diameter of not more than 3 μm was 2.0%. The percent production of coarse grains having an average grain diameter of not less than 12 μm was 14.2%. Thus, the grain diameter thus attained was not so small as compared with Example 1. Further, the grain size distribution was broad. The suspension was then allowed to undergo a polymerization reaction and post-treatment in the same manner as in Example 1 to obtain a toner. As a result, the average grain diameter and grain size distribution of the toner reproduced the results of the secondary suspension. The dispersion of the pigment in the toner grains was inhomogeneous. Table 1 shows the results of Comparative Example 1 along with Example 1. The toner thus obtained was used to prepare a developer. Using a commercially available copying machine, the developer was evaluated for printing properties. The resulting printed matter lacked sharpness and capability of reproducing fine line and showed fog and unevenness.

TABLE 1

| | Suspension treatment | | Grain diameter and grain size distribution | | | |
|---|---|---|---|---|---|---|
| | Pressure (psi) | Number of passes | D50* (μm) | ≦3 μm % | ≧12 μm % | 3 μm<--<12 μm % |
| Example 1 | 8,000 | 2 | 5.7 | 2.0 | 3.0 | 95.0 |
| Comparative | 8,000 | 2 | 23.5 | 1.0 | 60.0 | 39.0 |
| Example 1 | 8,000 | 4 | 8.4 | 2.0 | 14.2 | 83.8 |

*average grain diameter

EXAMPLE 2

Using the same composition as in Example 1, the same procedure as used in Example 1 was effected until the pre-suspension. The suspension was effected by passing the material once through Microfluidizer M-110T equipped with a Z-shaped chamber and an emulsifier comprising a capillary having an inner diameter of 0.08 inch and a length of 3 m connected to its product outlet under a processing pressure of 8,000 psi and a back pressure of 23.5 psi. The resulting oil drops had an average grain diameter of 6.2 μm. The percent production of finely divided grains having an average grain diameter of not more than 3 μm was 1.5%. The percent production of coarse grains having an average grain diameter of not less than 12 μm was 3.0%. The suspension was then allowed to undergo a polymerization reaction and post-treatment in the same manner as in Example 1 to obtain a toner having an average grain diameter of 6.1 μm and a narrow grain size distribution such that grains having a grain diameter of more than 3 μm but less than 12 μm account for 95.5% of all the grains and comprising a pigment homogeneously dispersed therein. The toner was measured for triboelectrification distribution in the same manner as in Example 1. As a result, a very sharp negative electrification distribution was shown free of opposite polarity. The toner was then used to prepare a developer in the same manner as in Example 1. Using a commercially available copying machine, the developer was evaluated for printing properties. As a result, a high definition printed matter with a high sharpness was obtained free of fog and unevenness.

COMPARATIVE EXAMPLE 2

Using the same composition as in Example 1, the same procedure as used in Example 1 was effected until the pre-suspension. The suspension was effected in the same manner as in Example 2 except that Microfluidizer M-110T had nothing connected to its product outlet. The resulting oil drops had an average grain diameter as large as 28.5 μm. In an attempt to bring the average grain diameter of oil drops close to the result of Example 2, the procedure for the suspension was further repeated three times. The resulting suspension comprised oil drops having an average grain diameter of 8.4 μm. The percent production of finely divided grains having an average grain diameter of not more than 3 μm was 2.5%. The percent production of coarse grains having an average grain diameter of not less than 12 μm was 18.2%. Thus, the grain diameter thus attained was not so small as compared with Example 2. Further, the grain size distribution was broad. The suspension was then allowed to undergo a polymerization reaction and post-treatment in the same manner as in Example 1 to obtain a toner. As a result, the average grain diameter and grain size distribution of the toner reproduced the results of the suspension. The dispersion of the pigment in the toner grains was inhomogeneous. Table 2 shows the results of Comparative Example 2 along with Example 2. The toner thus obtained was used to prepare a developer. Using a commercially available copying machine, the developer was evaluated for printing properties. The resulting printed matter lacked sharpness and capability of reproducing fine line and showed fog and unevenness.

TABLE 2

| | Suspension treatment | | Grain diameter and grain size distribution | | | |
|---|---|---|---|---|---|---|
| | Pressure (psi) | Number of passes | D50* (μm) | ≦3 μm % | ≧12 μm % | 3 μm<--<12 μm % |
| Example 2 | 8,000 | 1 | 6.2 | 1.5 | 3.0 | 95.5 |
| Comparative | 8,000 | 1 | 28.5 | 0.5 | 72.0 | 27.5 |
| Example 2 | 8,000 | 4 | 8.4 | 2.5 | 18.2 | 79.3 |

*average grain diameter

EXAMPLE 3

An oil phase was prepared in the same manner as in Example 1 except that the amount of styrene monomer/2-ethylhexyl acrylate/divinylbenzene used was 180 parts instead of 300 parts and 15 parts of carbon black was replaced by 120 parts of Magnetite BL-220 (available from Titan Kogyo K. K.). On the other hand, a dispersion medium containing 217 parts of a 10% calcium tertiary phosphate solution and 202 parts of a 0.178% aqueous solution of sodium dodecylbenzene-sulfonate in 353 parts of ion-exchanged water was prepared. To the dispersion medium were added 300 parts of the oil phase previously prepared. The mixture was then subjected to pre-suspension and secondary suspension in the same manner as in Example 1. The resulting suspension comprised oil drops having an average grain diameter of 5.9 μm. The percent production of finely divided grains having an average grain diameter of not more than 3 μm was 3.0%. The percent production of coarse grains having an average grain diameter of not less than 12 μm was 3.0%. The suspension was then allowed to undergo a polymerization reaction and post-treatment in the same manner as in Example 1 to obtain a toner having an average grain diameter of 5.9 μm and a narrow grain size distribution such that grains having a grain diameter of more than 3 μm but less than 12 μm account for 94.0% of all the grains and comprising a pigment homogeneously dispersed therein. 100 parts of the toner was then mixed with 1 part of colloidal silica to prepare a developer. Using a commercially available copying machine, the developer was evaluated for printing properties. As a result, a high definition printed matter with a high sharpness was obtained free of fog and unevenness.

COMPARATIVE EXAMPLE 3

Using the same composition as in Example 3, the same procedure as used in Comparative Example 1 was effected. The resulting oil drops had an average grain diameter as large as 21.5 μm. In an attempt to bring the average grain diameter of oil drops close to the result of Example 3, the procedure for the suspension was further repeated twice. The resulting suspension comprised oil drops having an average grain diameter of 7.6 μm. The percent production of finely divided grains having an average grain diameter of not more than 3 μm was 2.7%. The percent production of coarse grains having an average grain diameter of not less than 12 μm was 15.5%. Thus, the grain diameter thus attained was not so small as compared with Example 3. Further, the grain size distribution was broad. The suspension was then allowed to undergo a polymerization reaction and post-treatment in the same manner as in Example 1 to obtain a toner. As a result, the average grain diameter and grain size distribution of the toner reproduced the results of the secondary suspension. The dispersion of the pigment in the toner grains was inhomogeneous. Table 3 shows the results of Comparative Example 3 along with Example 3. The toner thus obtained was used to prepare a developer. Using a commercially available copying machine, the developer was evaluated for printing properties. The resulting printed matter lacked sharpness and capability of reproducing fine line and showed fog and unevenness.

EXAMPLE 4

Using the same composition as in Example 3, the same procedure as used in Example 3 was effected until the pre-suspension. The secondary suspension was effected in the same manner as in Example 2. The resulting suspension comprised oil drops having an average grain diameter of 5.0 μm. The percent production of finely divided grains having an average grain diameter of not more than 3 μm was 3.0%. The percent production of coarse grains having an average grain diameter of not less than 12 μm was 2.5%. The suspension was then allowed to undergo a polymerization reaction and post-treatment in the same manner as in Example 1 to obtain a toner having an average grain diameter of 5.0 μm and a narrow grain size distribution such that grains having a grain diameter of more than 3 μm but less than 12 μm account for 94.5% of all the grains and comprising a pigment homogeneously dispersed therein. The toner was then used to prepare a developer in the same manner as in Example 3. Using a commercially available copying machine, the developer was evaluated for printing properties. As a result, a high definition printed matter with a high sharpness was obtained free of fog and unevenness.

COMPARATIVE EXAMPLE 4

Using the same composition as in Example 3, the same procedure as used in Comparative Example 2 was effected. The resulting oil drops had an average grain diameter as large as 27.5 μm. In an attempt to bring the average grain diameter of oil drops close to the result of Example 3, the procedure for the suspension was further repeated three times. The resulting suspension comprised oil drops having an average grain diameter of 7.6 μm. The percent production of finely divided grains having an average grain diameter of not more than 3 μm was 2.6%. The percent production of coarse grains having an average grain diameter of not less than 12 μm was 20.3%. Thus, the grain diameter thus attained was not so small as compared with Example 4. Further, the grain size distribution was broad. The suspension was then allowed to undergo a polymerization reaction and post-treatment in the same manner as in Example 1 to obtain a toner. As a result, the average grain diameter and grain size distribution of the toner reproduced the results of the secondary suspension. The dispersion of the pigment in the toner grains was inhomogeneous. Table 4 shows the results of Comparative Example 4 along with Example 4. The toner thus obtained was used to prepare a developer. Using a commercially available copying machine, the developer was evaluated for printing properties. The resulting printed matter lacked sharpness and capability of reproducing fine line and showed fog and unevenness.

TABLE 3

| | Suspension treatment | | Grain diameter and grain size distribution | | | |
|---|---|---|---|---|---|---|
| | Pressure (psi) | Number of passes | D50* (μm) | ≦3 μm % | ≧12 μm % | 3 μm<--<12 μm % |
| Example 3 | 8,000 | 2 | 5.9 | 3.0 | 3.0 | 94.0 |
| Comparative | 8,000 | 2 | 21.5 | 1.5 | 68.0 | 30.5 |
| Example 3 | 8,000 | 4 | 7.6 | 2.7 | 15.5 | 81.8 |

*average grain diameter

TABLE 4

| | Suspension treatment | | Grain diameter and grain size distribution | | | |
|---|---|---|---|---|---|---|
| | Pressure (psi) | Number of passes | D50* (μm) | ≦3 μm % | ≧12 μm % | 3 μm<--<12 μm % |
| Example 4 | 8,000 | 1 | 5.0 | 3.0 | 2.5 | 94.5 |
| Comparative | 8,000 | 1 | 27.5 | 1.0 | 71.5 | 27.5 |
| Example 4 | 8,000 | 4 | 7.6 | 2.6 | 20.3 | 77.1 |

*average grain diameter

As mentioned above, the present invention provides suspended oil drops having a small grain diameter and an extremely narrow grain size distribution with a high percent production of grains having a desired grain diameter range (more than 3 but less than 12 μm). The suspended oil drops can then be polymerized to provide a high definition toner for electrostatic development free of fog and unevenness.

While the invention has been described in detail and with reference to specific embodiments thereof, it will be apparent to one skilled in the art that various changes and modifications can be made therein without departing from the spirit and scope thereof.

What is claimed is:

1. A process for producing a toner for developing electrostatic image which comprises preparing a suspension of a mixed solution of a polymerizable monomer system containing at least a coloring agent and a release agent and an aqueous medium system and polymerizing the suspension, wherein the suspension is prepared by jetting the mixed solution through a nozzle under elevated pressure in a flowing direction which is forced to vary so that the mixed solution collides with each other or with a predetermined plane, and immediately passing the mixed solution through an apparatus for throttling the path so that back pressure and shearing stress produced by said throttling apparatus are used to adjust the grain diameter and grain size distribution of the suspended grains.

2. The process for producing a toner for developing electrostatic image according to claim 1, wherein the back pressure is in the range of 0.1% to 50% of the processing pressure on jetting.

3. The process for producing a toner for developing electrostatic image according to claim 1, wherein the shearing stress is produced by adjusting the flow rate of the mixed solution to 100 m/min to 2,000 m/min through a capillary having a length of not less than 0.5 m.

4. A toner for developing electrostatic image prepared by a process which comprises preparing a suspension of a mixed solution of a polymerizable monomer system containing at least a coloring agent and a release agent and an aqueous medium system and polymerizing the suspension, wherein the suspension is prepared by jetting the mixed solution through a nozzle under elevated pressure in a flowing direction which is forced to vary so that the mixed solution collides with each other or with a predetermined plane to prepare suspended grains, and immediately passing the mixed solution through an apparatus for throttling the path so that back pressure and shearing stress produced by said throttling apparatus are used to adjust the grain diameter and grain size distribution of the suspended grains.

5. The toner for developing electrostatic image according to claim 4, wherein the back pressure is in the range of 0.1% to 50% of the processing pressure on jetting.

6. The toner for developing electrostatic image according to claim 4, wherein the shearing stress is produced by adjusting the flow rate of the mixed solution to 100 m/min to 2,000 m/min through a capillary having a length of not less than 0.5 m.

* * * * *